US005944509A

United States Patent [19]

Masters et al.

[11] Patent Number: 5,944,509

[45] Date of Patent: Aug. 31, 1999

[54] CANDLE DECORATING METHOD AND ARTICLE OF MANUFACTURE

[76] Inventors: Clarke S. Masters, 1681 D Soquel-San Jose Rd., Soquel, Calif. 95073; John B. Menig, 130 Thunderbird Ct., Aptos, Calif. 95003

[21] Appl. No.: 08/938,681

[22] Filed: Sep. 26, 1997

[51] Int. Cl.[6] ..... F23D 3/16

[52] U.S. Cl. ..... 431/288; 431/126; 156/153; 427/290

[58] Field of Search ..... 431/288, 126; 156/153, 154; 427/290, 300

[56] References Cited

U.S. PATENT DOCUMENTS

| | | | |
|---|---|---|---|
| 3,179,729 | 4/1965 | Richardson | 156/153 |
| 3,411,856 | 11/1968 | Crumrine . | |
| 3,947,232 | 3/1976 | Foster . | |
| 3,974,996 | 8/1976 | Violet . | |
| 4,017,729 | 4/1977 | Frazier, Jr. . | |
| 4,225,552 | 9/1980 | Chang . | |
| 4,845,635 | 7/1989 | Rosselli . | |
| 5,395,233 | 3/1995 | Karp | 431/289 |
| 5,512,005 | 4/1996 | Gulling . | |
| 5,632,615 | 5/1997 | DeGarmo | 431/288 |

*Primary Examiner*—Carroll Dority
*Attorney, Agent, or Firm*—H. M. Stanley

[57] ABSTRACT

The method disclosed herein relates to sculpting an image on a wax article such as a candle. The sculpting is done by pressure blasting entrained cutting grit through a mask or a sequence of masks. If a sequence of masks is sued to form the sculpted image, a sequence of colored pigments are entrained in the blast to impart different colors to the part of the image exposed by each mask in the sequence. A wax article of manufacture is produced having a concave sculpted surface with embedded colored cutting grit occupying predetermined portions of the image.

7 Claims, 2 Drawing Sheets fig-1
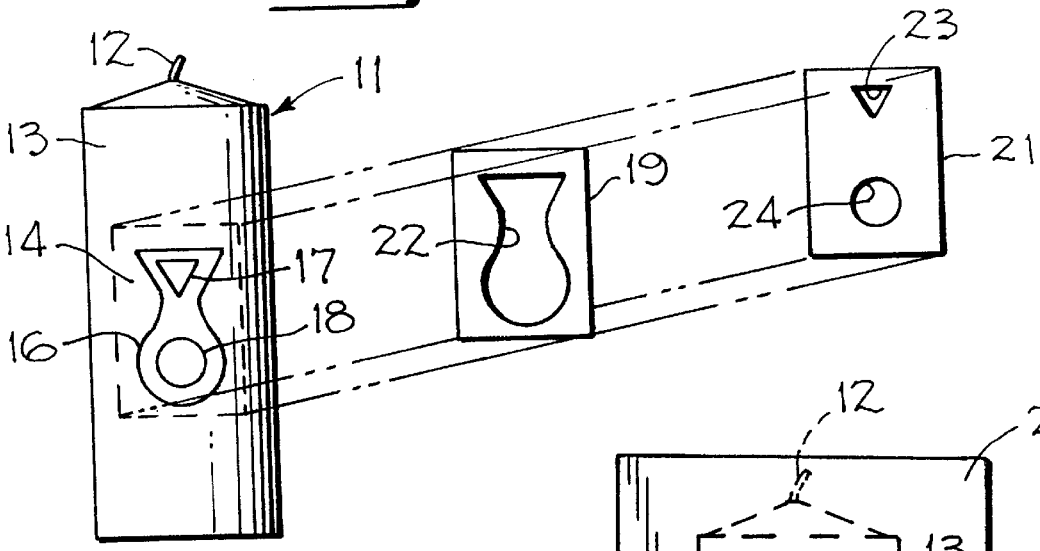
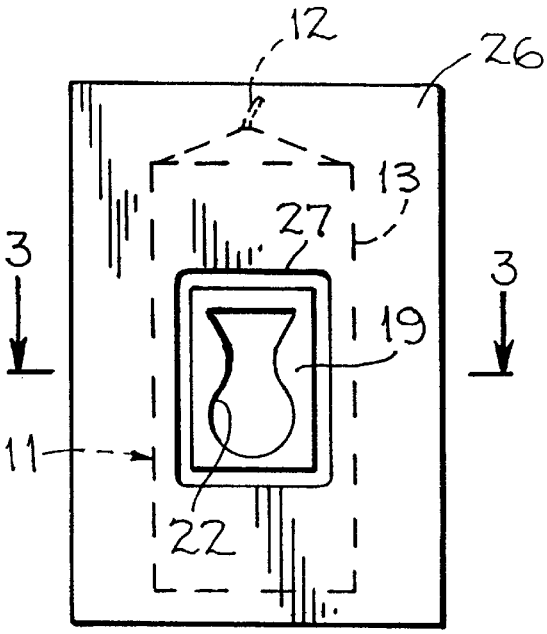
fig-2
fig 3
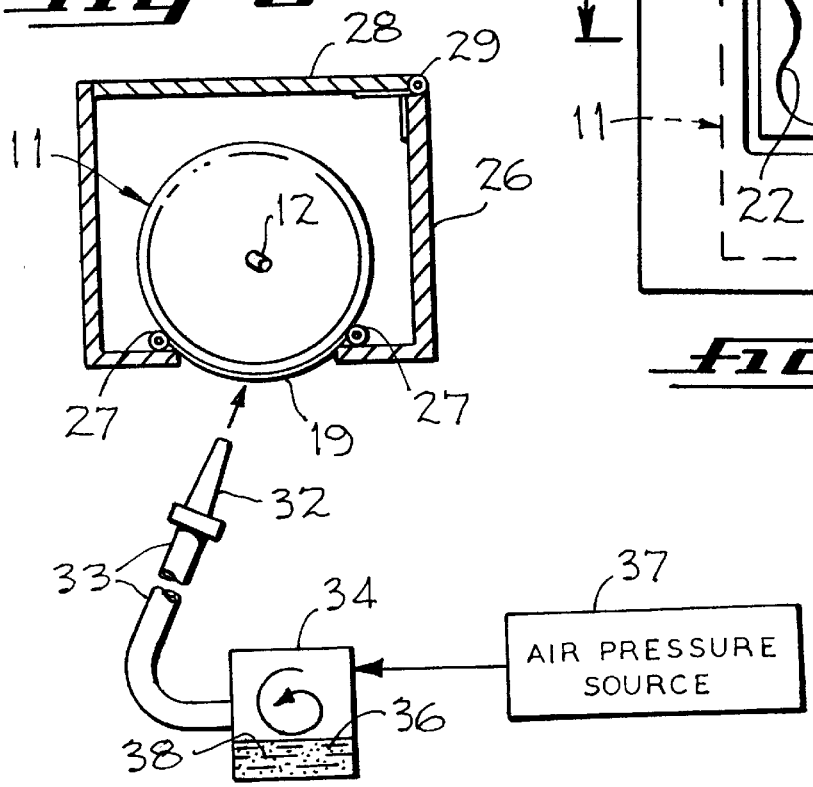

CANDLE DECORATING METHOD AND ARTICLE OF MANUFACTURE

SUMMARY OF THE INVENTION

The method disclosed herein relates to the decoration of a wax candle surface with a predetermined sculpted image. The method includes the steps of applying a mask to a portion of the wax candle surface, wherein the mask has an internal open area with an area outline corresponding to an outline of the predetermined sculpted image. Further, the process includes shielding the wax candle surface outside of the portion where the mask is applied and pressure blasting the portion of the wax candle surface where the mask is applied with a wax cutting grit so that the wax candle surface is sculpted within the internal open area of the mask. A color is applied to the wax cutting grit and a portion of the grit is embedded in the sculpted surface to provide a colored sculpted image. The mask is removed from the portion of the wax candle surface to reveal the decorated candle.

In another aspect of the invention a method is disclosed for obtaining a sculpted image on the surface of a wax candle which includes preparing a mask to be applied to the surface of the wax candle, the mask having an internal open area with an outline corresponding to an outline of the sculpted image. Applying the mask to a portion of the surface of the wax candle is followed by projecting a wax cutting medium in a pressurized stream toward the portion of the surface of the wax candle to which the mask is applied. Further, the surface of the wax candle is protected outside the portion to which the mask is applied. Coloring the wax cutting medium provides a sculpted image colored by embedded cutting medium. The mask is removed from the surface of the wax candle so that the sculpted image is apparent in the aforesaid portion of the surface.

A decorative wax article of manufacture is disclosed which has a surface to be decorated. A sculpted image is formed on the surface. The sculpted image is concave relative to the surface and a plurality of minute particles is embedded in the entire extent of the surface of the sculpted image, thereby imparting a predetermined appearance to the sculpted image.

BRIEF DESCRIPTION OF THE DRAWINGS

In yet another aspect of the invention a method of obtaining a concave sculpted image on a wax surface is disclosed wherein a portion of the wax surface is masked to expose an outline of the sculpted image. A wax cutting grit is entrained in an air stream and the grit entrained air stream is fanned across, displaced from and directed toward the outline of the sculpted image. The step of fanning the air stream is restricted to a time period insufficient to melt the exposed wax surface. The wax surface outside the masked area is shielded to protect it from the grit entrained air stream.

FIG. 1 is a perspective of a wax article of manufacture showing a sculpted image and a pair of masks prepared to be superimposed over the image.

FIG. 2 shows a wax article of manufacture in ghost line within an enclosure utilized in the present invention.

FIG. 3 is a section along the line 3—3 of FIG. 2.

DESCRIPTION OF THE PREFERRED EMBODIMENTS

Figure 4:
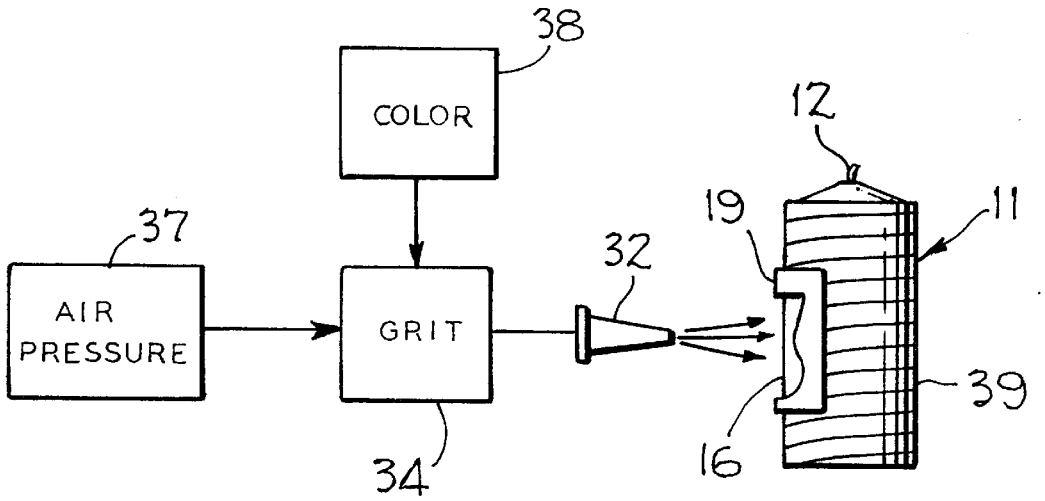
FIG. 4 is a diagram of part of the process of the present invention.

FIG. 1 shows a wax article of manufacture 11, in this case a wax candle, having a wick 12 running therethrough and a vertical surface 13. The external surface 13 has a portion 14 thereof (outlined in dashed lines in FIG. 1) in which appears a sculpted image 16. Within the sculpted image 16 appear two independent portions of the sculpted image designated portions 17 and 18.

Shown in a position in FIG. 1 to be superimposed over the portion 14 of the external candle surface 13 are a pair of masks 19 and 21. Mask 19 has an internal open area 22 which may be seen to have the shape of the outline of the sculpted image 16. Mask 21 has an open area 23 which corresponds to the portion 17 of the sculpted image. Mask 21 also has an open area 24 which corresponds to the portion 18 of the sculpted image. Open areas 23 and 24 on mask 21 could be formed on separate masks, for purposes which will become apparent hereinafter, but are shown in FIG. 1 on the same mask for purposes of simplifying the drawing.

Although any type of mask may be used, one preferred manner of making the mask for use in the method disclosed herein and for obtaining the described novel product of manufacture is discussed in the Insta-Mask™ process in U.S. Pat. No. 5,370,762. The artwork which depicts the image to be formed on a surface must be clean, with no halftones or gray areas. Black and white areas only are required. The artwork is copied to an ultra violet vellum which is created on a laser printer or a copy machine wherein the black area represents the area which will be open in the mask and will therefore represent the outline of the image to be created on the surface. The vellum containing representation of the image outline is placed with the ink side in contact with a paper back or a clear photo resist and exposed for a designated time to ultra violet light. The image is thus burned into the photo resist. The exposed photo resist is washed out using pressurized warm water spray for about one and a half to two minutes. Once washed out, the exposed photo resist is blotted and dried in a dryer or by air drying for an hour or more. Adhesive is then applied to the dried mask using a spray or a fine bristle brush. The adhesive is water based so it must be applied sparingly.

The mask is then positioned on the portion of the item surface where the image will be formed and burnished to fix it in place. The adhesive is pressure sensitive. The paper or clear backing is peeled away from the mask to expose the outline of the image on the surface of the item.

When a mask is applied to the portion 14 of a wax article surface 13, the sculpting of the image outlined by the mask is undertaken with a pressure blast. The medium blasted against the portion 14 covered by the mask 19 (and 21) may be a grit entrained in air or a grit entrained in water or any other fluid. For the purposes of this disclosure, the blast will be described as a grit entrained in air.

Following an application of a mask 19 to the portion 14 on the surface 13 of a wax article (such as the candle 11), the remainder of the surface 13 is shielded from contact with the blast by one of several means. The surface 13 outside of the portion 14 may be covered with a tape or it may be protected from the blast by an enclosure 26 as shown in FIG. 2. FIG. 2 shows the candle 11 in phantom line with the portion 14 of the surface 13 covered by the mask 19 having an open area 22 in the mask. The enclosure 26 surrounds the entire surface of the candle 11 except for the portion of the surface 14 where the mask 19 is applied. A seal 27 is disposed between the candle 13 and the enclosure 26 and surrounds the portion 14 of the candle surface.

As is more readily depicted in FIG. 3 the seal 27 is a resilient member, such as a latex tubing, which runs around the edges of the portion 14 on the candle surface. The enclosure 26, in one embodiment, may have a rear door 28 which is readily opened and closed rotating about a hinge 29. When the wax article such as the candle 11 is situated as shown in FIGS. 2 and 3, it is in a position so that a blast 31 emanating from a nozzle 32 can be directed at the mask 19. The nozzle 32 is connected by a tube or conduit 33 to a chamber 34 containing a fine cutting grit 36. An air pressure source 37 is directed to the chamber 34 such that the grit 36 is entrained in the air stream and delivered through the tube 33 to the nozzle 32. Thus, the air stream with the entrained grit is projected from the nozzle 32 as the blast 31. The open area 22 in the mask 19 allows access to the surface 13 of the wax article within the portion 14 of that surface and the grit sculpts the surface to form the concave image 16.

With reference now to FIG. 4 of the drawings, the air pressure source 37 is shown connected to the chamber 34 containing the grit 36. Also delivered to the chamber 34 is a color pigment 38 which adheres to the grit and is thereby entrained in the air stream and projected from the nozzle 32 in the blast 31. In this fashion the sculpted image 16 takes on the color of the pigment introduced from the color reservoir 38. It should be noted in FIG. 4 that the surface 13 of the wax article 11 is wrapped in a tape 39 to shield it from the blast 31. This is an alternative to the use of the enclosure 26 (FIGS. 2 and 3) for shielding the surface of the wax article outside the portion 14.

Figure 5:
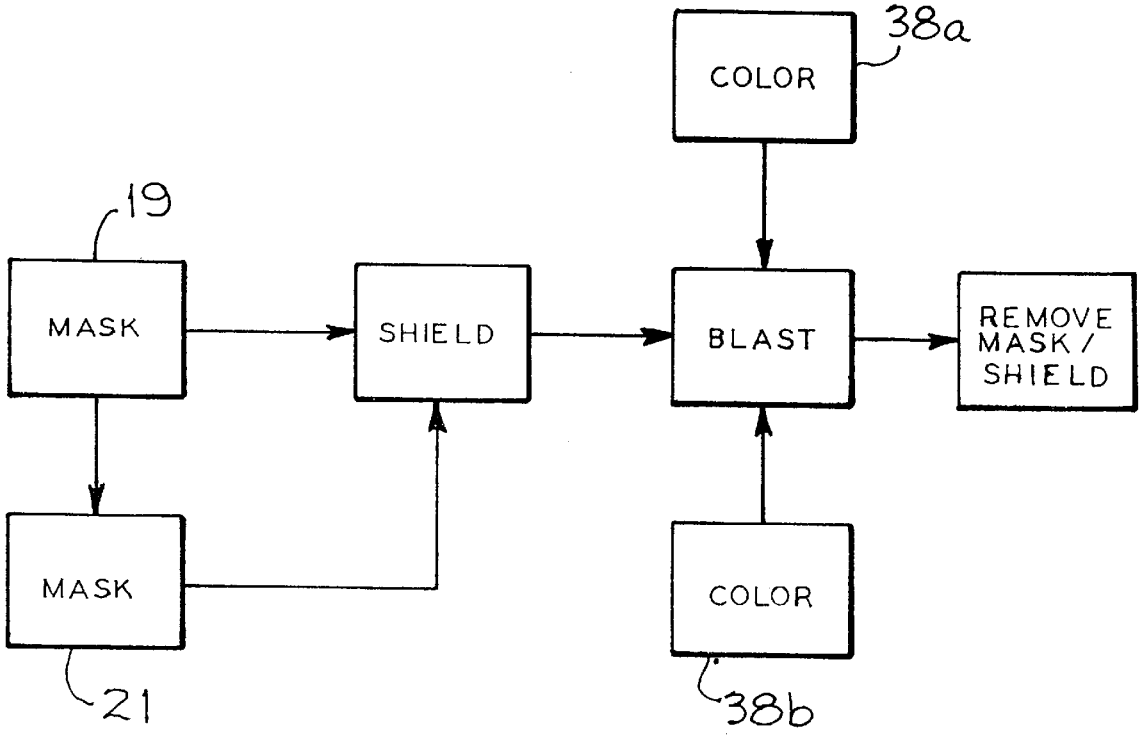
FIG. 5 is a block diagram depicting the process of the present invention.

In FIG. 5 of the drawings a diagram of the process of the present invention is shown. One or more masks, such as masks 19 and 21, is applied to the portion 14 of the surface 13 of the candle 1 1. The remainder of the surface 13 outside of the portion 14 is shielded, by means of the enclosure 26 of FIGS. 2 and 3 or by other means such as the tape 39 wrapping shown in FIG. 4. A blast is formed using air or some other fluid in which is entrained a cutting grit. A color is added to the blast corresponding to various ones of the masks which are applied to the portion 14 of the wax article surface. The colors are applied to the blast in sequence to correspond with the sequence of the multiple mask application. In this fashion the various portions of the sculpted image 16, such as portions 17 and 18, have embedded surface in colors differing from the remainder of the sculpted image 16. Once the sculpted image 16 is completed, upon application of the sequence of masks and corresponding sequence of colors, the wax article is removed from the enclosure 26 (or the shield such as the tape 39 shown in FIG. 4 is removed) and the mask is peeled off of the portion 14 of the surface 13 or is allowed to float off by immersion of the wax article 11 in warm water.

As a result of the process hereinbefore described, a decorative wax article of manufacture is obtained having a sculpted image formed on the surface thereof. The image has a concave sculpted surface relative to the surface of the wax article and the sculpted surface has a plurality of cutting particles embedded in the concave surface. The embedded cutting particles may be treated with a predetermined color, whereby the sculpted image surface takes on the predetermined color. Moreover, the sculpted image may result from a sequence of masks placed over the portion 14 of the wax article surface wherein a sequence of different colored cutting grit is entrained in the blast some of the colors corresponding to predetermined ones of the sequence of masks. In this fashion multicolored and complex images are sculpted on the surface of the wax article. The wax article, as is described herein, is generally and most commonly a wax candle, but may be any decorative wax article.

In practicing the process of the invention disclosed herein it has been found that a blast of air pressure in the range of 25 to 46 psi is appropriate. An aluminum oxide grit is entrained in the air blast. The nozzle 32 is held from 5 to 8 inches from the wax surface to be sculpted and should be moved or "fanned" across the blast area. The blast stream should not be held in a stationary position or pointed in one direction for more than a few seconds, or the heat created by the impingement of the grit particles against the wax will cause the wax surface to melt and the image as well as the image outline will become indistinct.

Although the best mode contemplated for carrying out the present invention has been shown and described herein, it will be understood that modification and variation may be made without departing from what is regarded to be the subject matter of the invention.

What is claimed:

1. A method of decorating a wax candle surface with a predetermined sculpted image, comprising the steps of applying a mask to a portion of the wax candle surface, the mask having an internal open area with an area outline corresponding to an outline of the predetermined sculpted image, shielding the wax candle surface outside the portion where the mask is applied, and pressure blasting the portion of the wax candle surface where the mask is applied whereby the wax candle surface is sculpted within the internal open area, wherein the step of pressure blasting utilizes a wax cutting grit, further comprising the steps of applying a color to the wax cutting grit to obtain a colored grit, and embedding the colored grit in the sculpted wax candle surface, whereby the predetermined sculpted image assumes the color of the colored grit, and removing the mask from the portion of the wax candle surface.

2. The method of claim 1 wherein the step of applying a mask comprises the steps of applying a plurality of masks in predetermined sequence, the plurality of masks having internal open areas which, when positioned in registration, have a collective internal open area with an outline corresponding to the predetermined sculpted image, wherein the step of applying a color to the wax cutting grit comprises the steps of coloring a plurality of batches of wax cutting grit a plurality of different predetermined colors, and wherein the step of pressure blasting comprises the steps of pressure blasting the plurality of batches of wax cutting grit in predetermined sequence corresponding to the predetermined sequence of mask application, whereby the predetermined sculpted image is multicolored.

3. A method of obtaining a sculpted image on the surface of a wax candle, comprising the steps of preparing a mask to be applied to the surface of the wax candle, the mask having an internal open area with an outline corresponding to an outline of the sculpted image, applying the mask to a portion of the surface of the wax candle, projecting a wax cutting medium in a pressurized stream toward the portion of the surface of the wax candle to which the mask is applied, protecting the surface of the wax candle outside the portion to which the mask is applied, coloring the wax cutting medium, whereby the sculpted image is colored by embedded cutting medium, and removing the mask from the surface of the wax candle, whereby the sculpted image is apparent in the portion of the surface.

4. The method of claim 3 wherein the step of preparing a mask comprises the steps of preparing a plurality of masks, the plurality of masks having internal open areas which, when positioned in registration, have a collective internal open area with an outline corresponding to the outline of the sculpted image, wherein the step of applying the mask comprises the steps of applying the plurality of masks in predetermined sequence to the portion of the surface of the wax candle, wherein the step of coloring the wax cutting medium comprises the steps of coloring a plurality of batches of wax cutting medium a plurality of different predetermined colors, and wherein the step of projecting the wax cutting medium comprises the steps of projecting the plurality of batches of wax cutting medium in predetermined sequence corresponding to the predetermined sequence of mask application, whereby the sculpted image is multicolored.

5. A method of obtaining a concave sculpted image on a wax surface, comprising the steps of masking a portion of the wax surface to expose an area within an outline of the sculpted image on the wax surface, entraining a wax cutting grit in an air stream, moving the grit entrained air stream back and forth across and displaced from the wax surface within the outline of the sculpted image, limiting continuous impingement of the grit entrained air stream on the exposed area of the wax surface to no more than a few seconds so that the wax within the outline of the sculpted image avoids melting, and shielding the wax surface outside the portion of the wax surface.

6. The method of claim 5 wherein the step of shielding comprises the steps of enclosing the wax surface outside the masked portion, and sealing the boundary between the masked portion and the enclosed surface.

7. The method of claim 5 wherein the step of shielding comprises the step of wrapping the wax surface outside the masked portion with a wrap impervious to the entrained wax cutting grit.

* * * * *